US006822524B2

(12) United States Patent
Hempel et al.

(10) Patent No.: US 6,822,524 B2
(45) Date of Patent: Nov. 23, 2004

(54) COMPACT MULTI-ELEMENT CASCADE CIRCULATOR

(75) Inventors: George W. Hempel, Hanson, MA (US); Raymond G. Jussaume, Somerville, MA (US)

(73) Assignee: Tyco Electronics Corporation, Middletown, PA (US)

( * ) Notice: Subject to any disclaimer, the term of this patent is extended or adjusted under 35 U.S.C. 154(b) by 195 days.

(21) Appl. No.: 10/067,435

(22) Filed: Feb. 4, 2002

(65) Prior Publication Data

US 2003/0030500 A1 Feb. 13, 2003

Related U.S. Application Data

(60) Provisional application No. 60/311,709, filed on Aug. 10, 2001.

(51) Int. Cl.[7] ..... H01P 1/32; H01P 1/38
(52) U.S. Cl. ..... 333/1.1; 333/24.2
(58) Field of Search ..... 333/1.1, 24.2

(56) References Cited

U.S. PATENT DOCUMENTS

| | | | | |
|---|---|---|---|---|
| 3,339,158 A | | 8/1967 | Passaro | |
| 3,534,296 A | * | 10/1970 | Carr | 333/1.1 |
| 3,701,054 A | | 10/1972 | Hagler et al. | |
| 3,739,302 A | | 6/1973 | McManus | |
| 3,781,704 A | * | 12/1973 | De Gruyl | 333/1.1 X |
| 5,172,080 A | * | 12/1992 | Fisher et al. | 333/1.1 |
| 5,638,033 A | | 6/1997 | Walker et al. | 333/1.1 |
| 5,653,841 A | | 8/1997 | Krishnamurthy et al. | 156/150 |
| 6,107,895 A | | 8/2000 | Butland et al. | 333/1.1 |

FOREIGN PATENT DOCUMENTS

| | | |
|---|---|---|
| FR | 2718890 | 10/1995 |
| GB | 1512605 | 6/1978 |

OTHER PUBLICATIONS

European Search Report, Oct. 18, 2002 on Applicaton No. EP 02 25 5404.

* cited by examiner

*Primary Examiner*—Benny Lee
*Assistant Examiner*—Stephen E. Jones

(57) ABSTRACT

A compact multi-element cascade circulator in which electrical and mechanical performance is enhanced while handling and assembly costs are reduced. The circulator includes a plurality of junctions connected in cascade to provide a plurality of non-reciprocal transmission path between signal ports on a network, and a metal housing with a cover in which the junctions are disposed. The plurality of junctions includes an oval permanent magnet, a multi-ferrite component including two (2) oblong ferrite elements, a dielectric constant medium disposed between the ferrite elements, and a plurality of conductor portions sandwiched between the ferrite elements. By configuring the multi-element cascade circulator to include the oval permanent magnet and the oblong ferrite component that are employed by more than one junction of the circulator, the multi-element cascade circulator achieves enhanced performance with reduced inventory and manufacturing costs.

12 Claims, 3 Drawing Sheets

COMPACT MULTI-ELEMENT CASCADE CIRCULATOR

CROSS REFERENCE TO RELATED APPLICATIONS

This application claims priority of U.S. Provisional Patent Application No. 60/311,709 filed Aug. 10, 2001 entitled COMPACT MULTI-ELEMENT CASCADE CIRCULATOR.

STATEMENT REGARDING FEDERALLY SPONSORED RESEARCH OR DEVELOPMENT

N/A

BACKGROUND OF THE INVENTION

The present invention relates generally to radio frequency and microwave circulators, and more specifically to a junction-type stripline circulator providing enhanced mechanical and electrical performance with a reduced cost of manufacture.

Radio Frequency (RF) and microwave circulators are known that employ a DC-biasing magnetic field generated in ferrite material enveloping a conductor to provide at least one non-reciprocal transmission path between signal ports on a network. A conventional junction-type stripline circulator comprises at least one junction configured as an interface between the signal ports. Each junction of the junction-type stripline circulator typically includes two (2) permanent magnets, two (2) ground plane portions disposed between the magnets, two (2) ferrite disks disposed between the ground plane portions, a dielectric constant medium disposed between the ferrite disks, and a conductor sandwiched between the ferrite disks and patterned to correspond to the transmission paths between the signal ports. The permanent magnets are configured to generate a DC-biasing magnetic field in the ferrite disks, thereby providing the desired non-reciprocal operation of the transmission paths between the signal ports on the network.

One drawback of the conventional junction-type stripline circulator is that it frequently provides inconsistent electrical performance. For example, a junction-type stripline circulator having four (4) signal ports typically comprises two (2) junctions disposed between the four (4) ports, in which each junction includes respective pluralities of magnets and ferrite disks and respective conductors. Further, the two (2) junctions of the 4-port stripline circulator are typically interconnected by a microstrip transmission line.

However, because the conventional 4-port junction-type stripline circulator comprises the two (2) interconnected junctions that include the respective pluralities of permanent magnets and ferrite disks, the DC-biasing magnetic fields generated by the respective magnets are frequently non-uniform. Further, the dielectric constant media disposed between the respective ferrite disk pairs also tend to be non-uniform. As a result, the desired non-reciprocal operation of the 4-port junction-type stripline circulator is sometimes difficult to achieve.

Moreover, because each junction comprises a respective stack of components including the permanent magnets, the ground plane portions, the ferrite disks, and the conductors, the number of parts included in the junction-type stripline circulator increases with the number of junctions of the circulator. This can significantly increase costs associated with handling and assembling multi-junction stripline circulators. Further, having respective stacks of components for each junction in the junction-type stripline circulator can cause uneven tolerance build-up in the component stacks, which can adversely affect stripline circulator performance.

It would therefore be desirable to have a junction-type stripline circulator that can be used in RF and microwave applications. Such a junction-type stripline circulator would be configured to provide enhanced mechanical and electrical performance, while reducing the costs of handling and assembly.

BRIEF SUMMARY OF THE INVENTION

In accordance with the present invention, a junction-type stripline circulator is provided in which electrical and mechanical performance is enhanced while handling and assembly costs are reduced. Benefits of the presently disclosed invention are achieved by configuring the junction-type stripline circulator to include an oval permanent magnet and an oblong ferrite component that can be employed by more than one junction of the circulator.

In one embodiment, the junction-type stripline circulator comprises a compact multi-element cascade circulator including a plurality of junctions connected in cascade to provide a plurality of non-reciprocal transmission paths between signal ports on a network. The plurality of junctions comprises a single oval permanent magnet, an oblong ground plane disposed near the permanent magnet, a ferrite component including two (2) oblong ferrite elements disposed near the ground plane, and a conductor sandwiched between the ferrite elements. A dielectric constant medium is disposed between the two (2) ferrite elements. Further, the conductor is patterned to correspond to the configuration of the transmission paths between the signal ports. The multi-element cascade circulator further includes a metal housing having an open top into which the plurality of adjacent junctions is disposed, and a metal cover configured to enclose the top of the housing to secure the adjacent junctions therein. The metal housing has a plurality of slots through which respective contact terminals of the conductor protrude to make contact with the signal ports on the network.

The plurality of adjacent junctions further comprises two (2) oval pole pieces associated with the permanent magnet, and an oval cover return component. A first oval pole piece is disposed between the magnet and the ground plane, and a second oval pole piece is disposed between the base of the housing and the multi-ferrite component. The cover return component is disposed between the cover and the permanent magnet.

In this embodiment, the combination of the ground plane, the multi-ferrite component, and the conductor forms a Radio Frequency (RF) or microwave circuit configured to provide desired non-reciprocal transmission paths between the network signal ports. Further, the combination of the pole pieces, the permanent magnet, the metal housing, the cover return component, and the metal cover forms a magnetic circuit configured to generate a DC-biasing magnetic field in the multi-ferrite component, thereby achieving the desired non-reciprocal operation of the transmission paths. Moreover, the two (2) pole pieces are configured to enhance the homogeneity of the magnetic field in the multi-ferrite component, and the cover return component is configured to provide an easy return path for the magnetic flux associated with the DC-biasing magnetic field from the ferrite elements to the permanent magnet.

By configuring the compact multi-element cascade circulator to include the oval permanent magnet and the oblong ferrite component that can be employed by more than one junction of the circulator, the circulator achieves numerous benefits. For example, the performance of the multi-element cascade circulator is enhanced. Particularly, the electrical performance of the circulator is more consistent because the dielectric constant medium between the junctions is uniform throughout the RF or microwave circuit. Other benefits include reduced insertion loss, more consistent return loss values, more uniform DC-biasing magnetic fields, better power handling due to improved distribution of heat in the oblong ferrite component, reduced tolerance build-up because the oblong ferrite component eliminates an air line interface that typically exists in conventional multi-junction-type stripline circulator configurations, simpler and easier fixturing and assembly because fewer parts are involved and critical transformer positions are eliminated, lower overall costs because fewer parts are handled in stockrooms and during assembly, lower total material costs due to the combining of parts and the reduction of part quantities, and quicker and more uniform magnetic field settings because the oval permanent magnet design allows the use of a c-coil degausser, which generally cannot be used with conventional junction-type stripline circulator designs.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which.

DETAILED DESCRIPTION OF THE INVENTION

U.S. Provisional Patent Application No. 60/311,709 filed Aug. 10, 2001 is incorporated herein by reference.

A junction-type stripline circulator is disclosed that has enhanced electrical and mechanical performance and a reduced cost of manufacture. In the presently disclosed junction-type stripline circulator, an oval permanent magnet and an oblong ferrite component are employed by more than one junction of the circulator to eliminate uneven tolerance build-up and non-uniform dielectric constant media between the junctions, which can degrade the mechanical and electrical performance of the device. Further, by providing the oval permanent magnet and the oblong ferrite component in the multi-junction stripline circulator, the total parts count and the total assembly time of the device are reduced, thereby reducing inventory and manufacturing costs.

Figure 1:
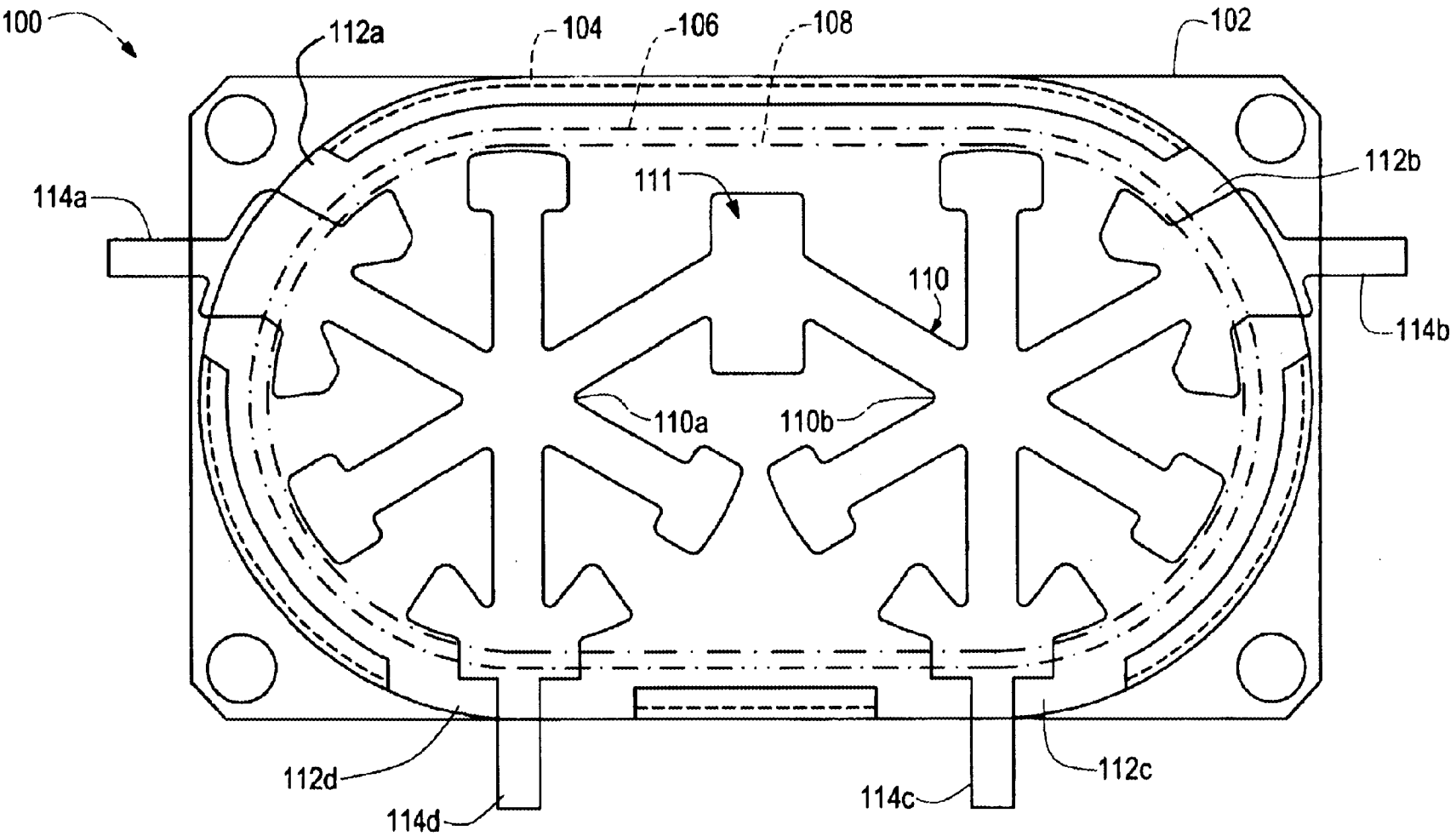
FIG. 1 is a plan view of a compact multi-element cascade circulator according to the present invention.

FIG. 1 depicts a plan view of an illustrative embodiment of a compact multi-element cascade circulator 100 configured to provide a plurality of non-reciprocal transmission paths between signal ports on a network (not shown), in accordance with the present invention. In the illustrated embodiment, the multi-element cascade circulator 100 includes a single oval permanent magnet 106, a single oblong ferrite component 108, a center conductor 110 sandwiched between two (2) oblong ferrite elements of the ferrite component 108, and an oval cover return component 104. The permanent magnet 106, the ferrite component 108, the center conductor 110, and the cover return component 104 are disposed in a metal housing 102 having an open top and a plurality of slots 112*a*–112*d* through which respective contact terminals 114*a*–114*d* of the center conductor 110 protrude to make contact with, e.g., four (4) signal ports (not shown) on the network.

For example, the center conductor 110 may be formed from a thin sheet of foil or copper, or any other suitable electrically conductive material. Further, the center conductor 110 may be patterned to correspond to the transmission paths between the signal ports by way of etching, stamping, photolithography, or any other suitable process.

It should be noted that the multi-port multi-element cascade circulator 100 comprises a plurality of junctions connected in cascade and configured as an interface between the plurality of signal ports. Specifically, a first junction includes a center conductor portion 110*a*, and a second junction connected in cascade to the first junction at a common conductor section 111 includes a center conductor portion 110*b*. The permanent magnet 106, the ferrite elements of the ferrite component 108, and the cover return component 104 are configured to overlay and be shared by the first and second junctions of the circulator 100. It is understood that the multi-element cascade circulator 100 may be configured to accommodate one or more junctions to provide transmission paths between a desired number of network signal ports.

Figure 2:
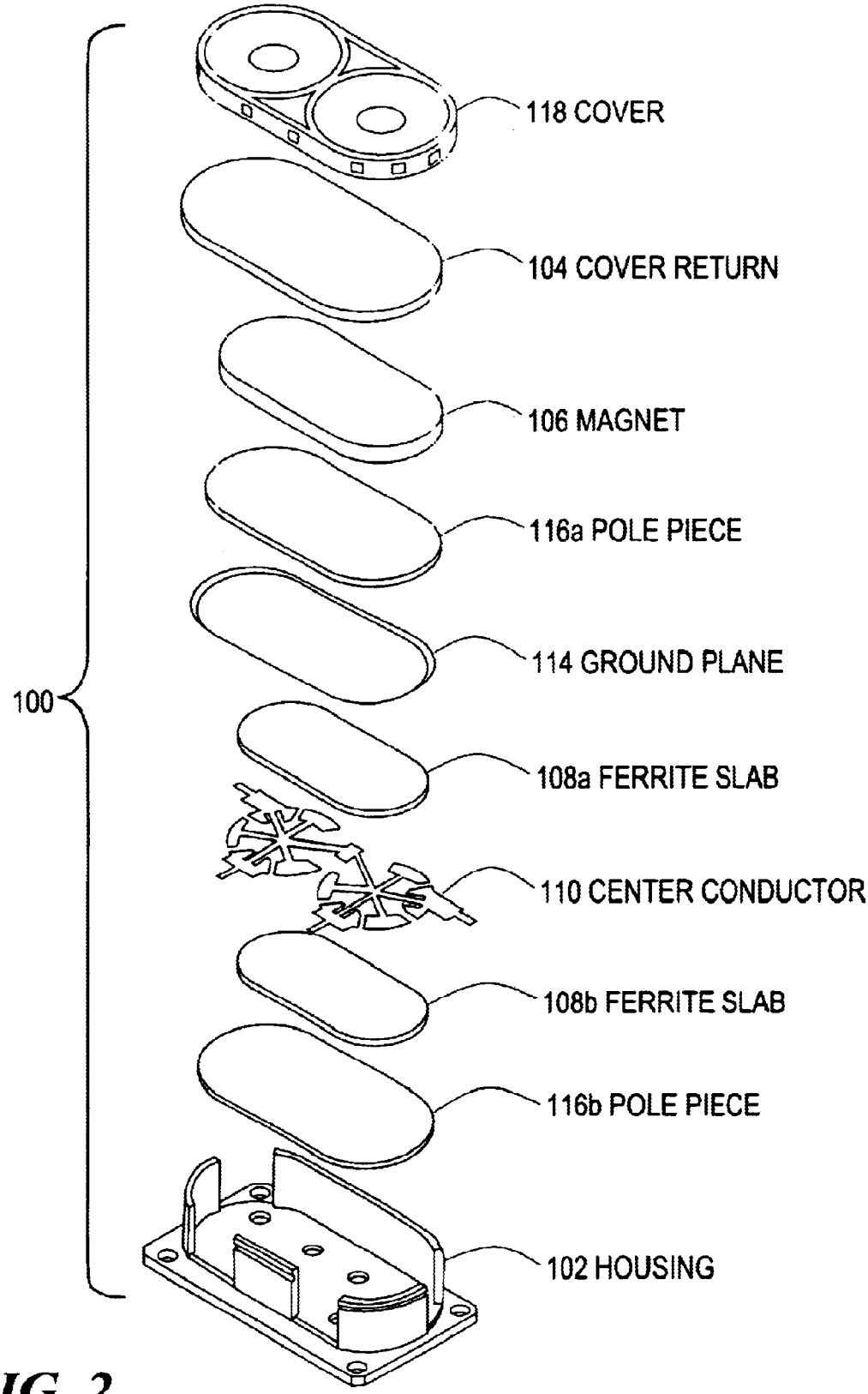
FIG. 2 is an exploded view of the multi-element cascade circulator of FIG. 1.

FIG. 2 depicts an exploded view of the multi-element cascade circulator 100 (see also FIG. 1). As shown in FIG. 2, the multi-element cascade circulator 100 includes the permanent magnet 106, the ferrite component 108 comprising the ferrite elements 108*a* and 108*b,* the center conductor 110, the cover return component 104, and the metal housing 102.

Specifically, the permanent magnet 106 operates in conjunction with pole pieces 116*a* and 116*b*, which are configured to enhance the homogeneity of a DC-biasing magnetic field generated in the ferrite component by the magnet 106. In the illustrated embodiment, the permanent magnet 106 is disposed between the cover return component 104 and the pole piece 116*a*, and the pole piece 116*b* is disposed between the ferrite element 108*b* and the base of the housing 102. It is understood that the DC-biasing magnetic field may alternatively be generated by a pair of permanent magnets or by an electromagnet.

The combination of the ferrite elements 108*a* and 108*b,* a dielectric constant medium (e.g., air) disposed between the ferrite elements 108*a* and 108*b,* the center conductor 110 sandwiched between the ferrite elements 108*a* and 108*b,* and a ground plane 114 disposed between the pole piece 116*a* and the ferrite element 108*a* forms a Radio Frequency (RF) or microwave circuit, which is configured to provide desired non-reciprocal transmission paths between the four (4) network signal ports when a suitable DC-biasing magnetic field is generated in the ferrite component 108. For example, the RF or microwave circuit may be configured to transmit power in forward directions along respective transmission paths extending from the contact terminal 114*a* to the contact terminal 114*b*, from the contact terminal 114*b* to the contact terminal 114*c*, and from the contact terminal 114*d* to the contact terminal 114*a*, while preventing the transmission of power in corresponding reverse directions (i.e., the contact terminal 114*a* is isolated from the contact terminal 114*b*, the contact terminal 114*b* is isolated from the contact terminal 114*c*, and the contact terminal 114*d* is isolated from the contact terminal 114*a*). It is understood that the RF or microwave circuit may be configured to transmit power in forward directions and prevent such transmission in corresponding reverse directions along alternative non-reciprocal transmission paths between the network signal ports.

Moreover, the combination of the pole pieces 116*a* and 116*b*, the permanent magnet 106, the metal housing 102, the cover return component 104, and a metal cover 118 forms a magnetic circuit, which is configured to generate the suitable DC-biasing magnetic field in the ferrite component 108 between the pole pieces 116*a* and 116*b*. The cover return component 104 is configured to provide an easy return path for the magnetic flux associated with the DC-biasing magnetic field from the ferrite elements 108*a* and 108*b* back to the permanent magnet 106.

For example, the metal housing 102 and the metal cover 118 may be made of iron, steel, or any other suitable ferromagnetic material capable of completing the magnetic circuit between the pole pieces 116*a* and 116*b*.

Figure 3A:
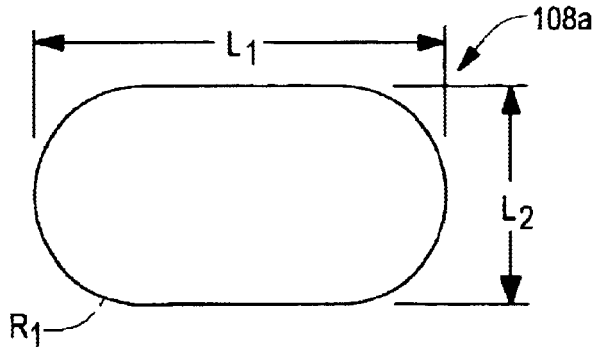
FIG. 3*a* is a plan view of an oblong ferrite component included in the multi-element cascade circulator of FIG. 1.

FIG. 3*a* depicts a plan view of the ferrite element 108*a* included in the multi-element cascade circulator 100 (see FIGS. 1 and 2). It should be understood that the ferrite element 108*b* (see FIGS. 1 and 2) has a configuration similar to that of the ferrite element 108*a*. For example, the material used to make the ferrite elements 108*a* and 108*b* may be TTVG-1200 or any other suitable material. In a preferred embodiment, the dimension $L_1$ is about 1.400 inches, the dimension $L_2$ is about 0.690 inches, and the radius $R_1$ is about 0.345 radians. Further, the surface finish dimensions of the ferrite element 108*a* are preferably less than about 20 $\mu$inches.

Figure 3B:
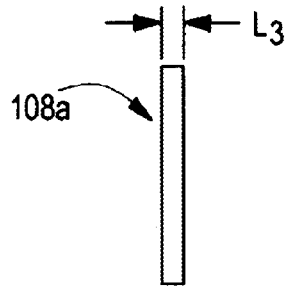
FIG. 3*b* is a side view of the oblong ferrite component of FIG. 3*a;*

FIG. 3*b* depicts a side view of the ferrite element 108*a* shown in FIG. 3*a*. In a preferred embodiment, the dimension $L_3$ is about 0.040 inches. In general, the number of junctions included in the multi-element cascade circulator 100 (see FIG. 1) determines the size of the ferrite elements 108*a* and 108*b*.

Figure 4A:
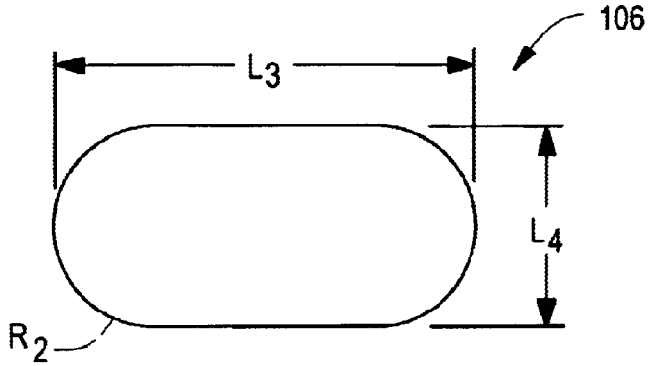
FIG. 4*a* is a plan view of an oval permanent magnet included in the multi-element cascade circulator of FIG. 1.

FIG. 4*a* depicts a plan view of the permanent magnet 106 included in the multi-element cascade circulator 100 (see FIG. 1). For example, the material used to make the permanent magnet 106 may comprise anisotropic ceramic 8 (barium ferrite) or SSR-360H according to the Magnetic Materials Producers Associates (MMPA) standard specifications, or any other suitable material. In a preferred embodiment, the dimension $L_3$ is about 1.446 inches, the dimension $L_4$ is about 0.735 inches, and the radius $R_2$ is about 0.367 radians.

Figure 4B:
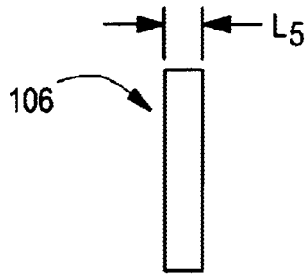
FIG. 4*b* is a side view of the oval permanent magnet of FIG. 4*a*.

FIG. 4*b* depicts a side view of the permanent magnet 106. In a preferred embodiment, the dimension $L_5$ is about 0.150 inches. Moreover, the indication "—0—" shown in FIG. 4*b* designates the magnetic orientation of the permanent magnet 106.

It will be appreciated that by configuring the compact multi-element cascade circulator 100 (see FIGS. 1 and 2) to include the permanent magnet 106 and the ferrite component 108 that are shared by two (2) or more junctions of the circulator 100, a uniform DC-biasing magnetic field can be generated in the ferrite component 108 for use by the two (2) or more junctions. Further, the dielectric constant medium disposed between the ferrite elements 108*a* and 108*b* of the ferrite component 108 is uniform throughout the two (2) junctions of the circulator 100. As a result, the electrical performance of the multi-element cascade circulator 100 is enhanced, e.g., insertion losses are reduced and isolation between the signal ports is increased. Further, the mechanical performance of the circulator 100 is improved, e.g., uneven tolerance build-up between the two (2) junctions is virtually eliminated. Moreover, because the presently disclosed circulator configuration reduces the total parts count of the device, inventory and assembly costs are also reduced.

It will further be appreciated by those of ordinary skill in the art that modifications to and variations of the above-described compact multi-element cascade circulator may be made without departing from the inventive concepts disclosed herein. Accordingly, the invention should not be viewed as limited except as by the scope and spirit of the appended claims.

What is claimed is:

1. A radio frequency/microwave junction-type circulator, comprising:

a plurality of signal ports;

a plurality of junctions connected in cascade and configured to provide a plurality of transmission paths between the signal ports, each junction including a conductor element patterned to correspond to at least a portion of the plurality of transmission paths;

a ferrite component configured to overlay the plurality of junctions;

an oval shaped permanent magnet arranged in relation to the ferrite component so as to generate a magnetic field in the ferrite component, thereby causing non-reciprocal operation of the plurality of transmission paths between the signal ports; and at least a first pole piece disposed between the permanent magnet and the ferrite component.

2. The circulator of claim 1 wherein the ferrite component comprises two ferrite elements and the conductor elements are sandwiched between the two ferrite elements.

3. The circulator of claim 2 further including a dielectric constant medium disposed between the ferrite elements and a ground plane disposed between the ferrite component and the permanent magnet.

4. The circulator of claim 3 wherein the ferrite elements, the dielectric constant medium, the conductor elements, and the ground plane are arranged in relation to each other so as to form a radio frequency/microwave circuit for causing the non-reciprocal operation of the transmission paths when the magnetic field is generated in the ferrite component.

5. The circulator of claim 1, wherein the metal housing includes a cover and a base portion and the circulator further comprises a second pole piece disposed between the base portion of the housing and the conductor elements, and a cover return component disposed between the housing cover and the permanent magnet.

6. The circulator of claim 5 wherein the first and second pole pieces, the permanent magnet, the metal housing, and the cover return component are arranged in relation to each other so as to form a magnetic circuit for generating the magnetic field in the ferrite component.

7. The circulator of claim 1 wherein the conductor elements comprise corresponding portions of a single conductor component.

8. The circulator of claim 1 wherein the plurality of junctions, the ferrite component, and the permanent magnet are disposed in a metal housing.

9. A method of manufacturing a radio frequency/microwave junction-type circulator, comprising the steps of:

providing a plurality of junctions connected in cascade and configured to form a plurality of transmission paths between a plurality of signal ports, each junction including a conductor element patterned to correspond to at least a portion of the plurality of transmission paths;

providing a ferrite component configured to overlay the plurality of junctions;

providing an oval permanent magnet arranged in relation to the ferrite component so as to generate a magnetic field in the ferrite component, thereby causing non-reciprocal operation of the transmission paths between the plurality of signal ports; and providing a first pole piece disposed between the permanent magnet and the ferrite component.

10. The method of claim 9 further including the step of disposing the plurality of junctions, the ferrite component, and the permanent magnet in a metal housing.

11. The method of claim 10 further including the steps of providing a second pole piece disposed between a base portion of the metal housing and the conductor elements, and providing a cover return component disposed between a cover of the metal housing and the permanent magnet.

12. The method of claim 9 further including the steps of providing a dielectric constant medium between first and second ferrite elements of the ferrite component, and providing a ground plane disposed between the ferrite component and the permanent magnet.

* * * * *